United States Patent [19]

Luoma

[11] Patent Number: 4,603,676

[45] Date of Patent: Aug. 5, 1986

[54] BOW DRAWBACK MECHANISM

[76] Inventor: Eugene H. Luoma, 1325 Normanna Rd., Duluth, Minn. 55803

[21] Appl. No.: 601,231

[22] Filed: Apr. 17, 1984

[51] Int. Cl.[4] ..... F41B 5/00; F41C 19/00

[52] U.S. Cl. ..... 124/25; 124/35 A; 124/DIG. 1; 124/40

[58] Field of Search ..... 124/23 R, 24 R, 41, 124/22, 35 A, 35 R, 25, 67, 37; 222/391

[56] References Cited

U.S. PATENT DOCUMENTS

| | | | |
|---|---|---|---|
| 369,153 | 8/1887 | Alley | 124/21 |
| 2,542,777 | 2/1951 | Loew | 124/67 |
| 2,926,650 | 3/1960 | Irwin | 124/35 A |
| 4,072,254 | 2/1978 | Cox | 222/391 |

*Primary Examiner*—Richard C. Pinkham
*Assistant Examiner*—Benjamin Layno
*Attorney, Agent, or Firm*—Basile, Weintraub & Hanlon

[57] ABSTRACT

A crossbow having a bow prod with a string attached to its opposite ends, engageable by a releasable catch for holding the string at a cocked position spaced rearwardly from the bow prod. The releasable catch is mounted to a cocking mechanism that is slidably movable along a rod, the fore end portion of which is connected to the midsection of the bow prod. The cocking mechanism, when adjacent to the fore end portion of the rod, permits the bowstring to be drawn back by means of a mechanical leverage advantage obtained from the cocking mechanism.

2 Claims, 5 Drawing Figures

BOW DRAWBACK MECHANISM

BACKGROUND OF THE INVENTION

I. Field of the Invention

The present invention relates to bows and crossbows and, in particular, to a mechanism for drawing back a bowstring.

II. Description of the Prior Art

Bows and crossbows are centuries old and in the case of crossbows have been made in the form of a shoulder-held or rifle-like weapon generally comprising a stock which includes a butt and a fore end portion, a resilient, flexible crosspiece called a bow prod which is supported at the forward end of the stock, a string whose opposite ends are attached to the corresponding opposite ends of the bow prod, and a releasable catch for holding the string at a position spaced rearwardly from the bow prod when the bow is cocked.

In conventional crossbows, when the string of the crossbow lies adjacent to the bow prod in what is called the rest or uncocked position of the string, there is little or no tension in the string and the bow prod is substantially unstressed. Crossbows are generally cocked by grasping the string with the hands and drawing the string along the fore end portion to a catch. When the bow is in the cocked position and the bow prod is bent, there is a large tension in the string. Because of this large tension in the bowstring, the bow may be difficult or impossible to operate for users who lack the necessary arm, hand and back muscle strength. Furthermore, as the surface area of the string over which the user can exert the necessary pressure is severely limited by the diameter of the string, some degree of pain may be inflicted on the user.

In the past, to enable crossbows to be cocked more easily, there have been provided for use with certain crossbows separate tools which have relatively movable parts engageable respectively with the stock and with the string. These tools can then be manipulated to move the string along the stock to the catch. Such tools may include a handle having an adequate surface area over which a user can apply the force necessary to cock the bow without suffering discomfort and the tool can be arranged to provide a mechanical advantage so that the force which is necessary for the user to apply to the tool can be less than the force which the tool applies to the string. The use of a separate tool for cocking a crossbow is inherently inconvenient as the tool must be carried in addition to the bow and bolts. Another method known to those skilled in the field of crossbows comprises those mechanisms in which a butt is pivotally connected to the fore end portion of the bow and is also connected with cocking means so that the butt of the crossbow may be used as a lever to cock the bow. Such arrangements, while commercially successful, are complicated in the design, expensive to manufacture and still require a considerable amount of physical strength to achieve cocking.

SUMMARY OF THE INVENTION

The present invention, which will be described subsequently in greater detail, comprises a flexible bow prod having the fore end of a drawback rod attached to its midsection. The drawback rod slidably supports a cocking mechanism which has a catch that engages the bowstring. The cocking mechanism is movable along the drawback rod from a rest position adjacent the bow prod to a cocked position spaced rearwardly from the bow prod. Suitable mechanical elements within the cocking mechanism provide mechanical advantage which permits the user to draw the bow with a minimum amount of physical strength.

It is therefore a primary object of the present invention to provide a bow having a cocking mechanism for drawing back and holding in a cocked position the bowstring of a modern state-of-the-art, heavy draw-weight bow. It is a further object of the present invention to provide such a bow with means for establishing a consistent draw length each time the bow is cocked, resulting in more accurate shooting.

It is yet another object of the present invention to provide a bow of the type described herein that has a unique means for bowstring release, also resulting in greater accuracy.

It is still a further object of the present invention to provide a cocking mechanism adapted for crossbows which may be utilized on any existing bow so as to provide the user thereof, and in particular those members of the public who are of lesser physical stature, with a means of participating in the sport of archery.

Other objects, advantages and applications of the present invention will become apparent to those skilled in the art of bow cocking mechanisms when one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figure 1:
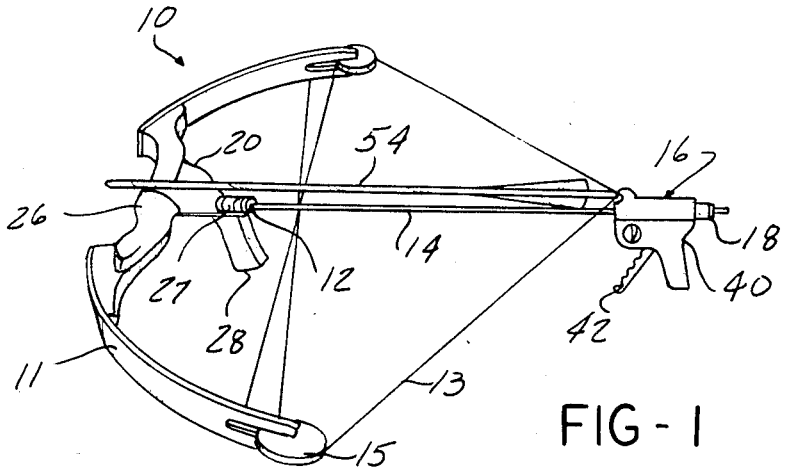
FIG. 1 is a perspective view of a bow incorporating one example of the present invention in the form of a cocking mechanism with the bow being illustrated in a fully drawn (cocked) position.

Referring now to the drawing and, in particular, to FIG. 1 wherein there is illustrated one example of the present invention in the form of a crossbow 10 which comprises a resilient, flexible bow prod 11 which is supported on the fore end portion 12 of a drawback rod 14. The flexible bow prod 11 has a string 13, the opposite ends of which are mounted through a suitable conventional pulley arrangement 15 to the opposite ends of the bow prod 11. The drawback rod 14 slidably extends through a cocking mechanism 16, which will be described in greater detail hereinafter. The rear section of the drawback rod 14 slidably mounts a stop collar 18 which permits an adjustment of the position to which the crossbow 10 may be drawn back.

Figure 2:
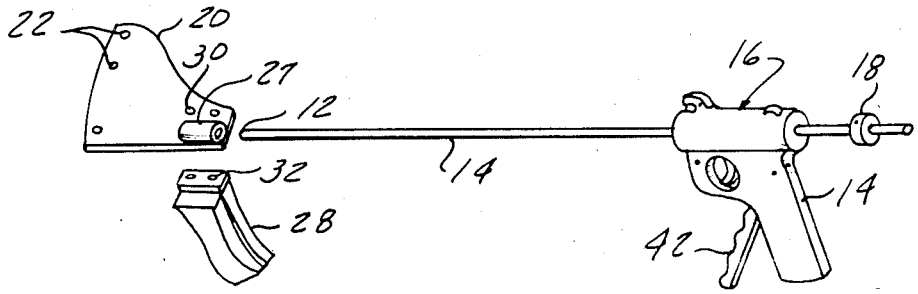
FIG. 2 is a partially exploded, perspective view of the mounting plate, drawback rod and cocking mechanism utilized to provide the mechanical advantage described hereinafter.

The bow prod 11 is attached to the drawback rod 14 by means of a mounting plate 20 which, as can best been seen in FIG. 2, is provided with a plurality of mounting apertures 22 through which suitable fasteners 24 extend and which fasteners 24 are received by threaded apertures (not shown) in the lower midsection 26 of the bow prod 11. The mounting plate 20 mounts a cylindrically shaped socket 27 which receives and supports the fore end portion 12 of the drawback rod 14. A pistol-type grip 28 is attached to the bottom side of the mounting plate 20 by means of suitable fasteners (not shown) which extends through apertures 30 into threaded apertures 32 in the upper surface of the pistol grip 28.

Figure 3:
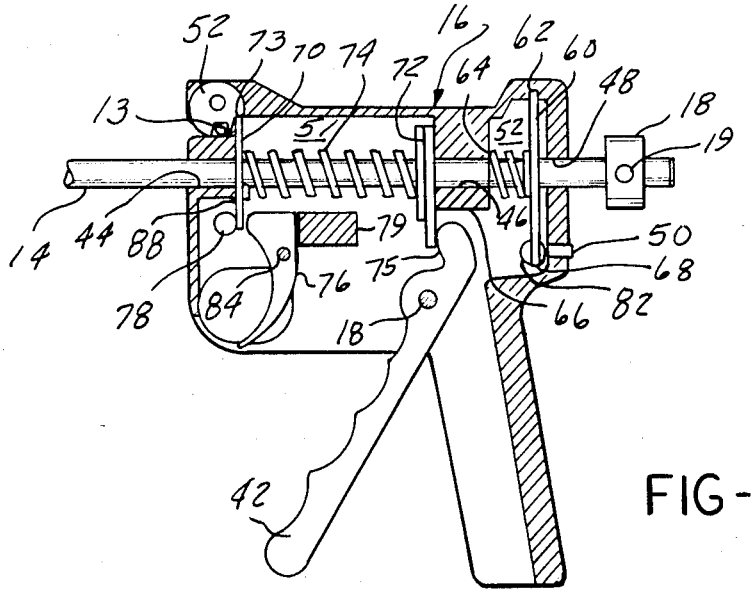
FIG. 3 is an enlarged, cross-sectional view of the cocking mechanism illustrated in FIGS. 1 and 2.
Figure 4:
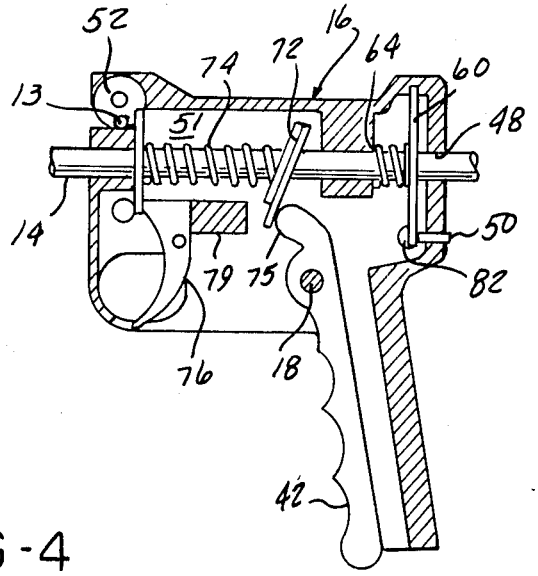
FIG. 4 is a view similar to FIG. 3 illustrating the position of the cocking plate and lock lever when the cocking handle is fully compressed.
Figure 5:
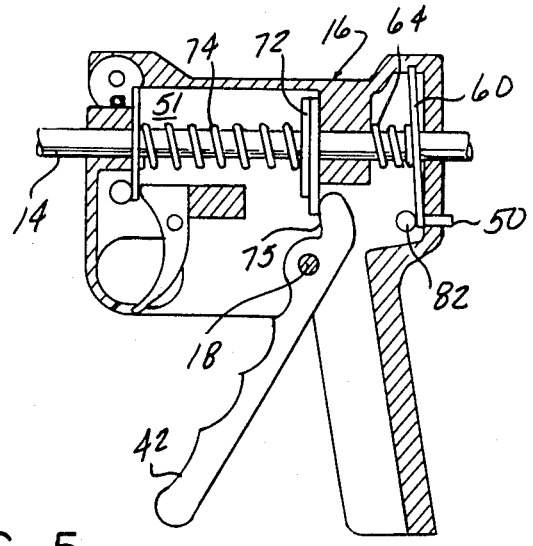
FIG. 5 is a view similar to FIG. 3 illustrating the cocking mechanism at-rest position.

Referring now to FIG. 3 for a detailed description of the cocking mechanism 16, it can be seen that the same is comprised of a housing 40, the lower portion of which is opened to permit the projection therefrom of a cocking handle 42, the manner of operation of which will be described hereinafter. The housing 40 is provided with aligned bores 44, 46 and 48 separating the interior of the housing into fore and aft cavities, respectively numbered 51 and 52, and through which slidably extends the drawback rod 14.

The cocking mechanism 16 is provided with a release button 50 which, when pressed, permits the cocking mechanism 16 to be moved along the full length of the drawback rod 14. Initially the cocking mechanism 16 is positioned adjacent the fore end portion 12 of the drawback rod 14 wherein a releasable catch 52 engages the bowstring 13.

As will be described hereinafter, the squeezing action exerted on the cocking handle 42 will move the cocking mechanism 16 (rightwardly as viewed in FIGS. 1 and 2) from the at-rest position rearwardly to the fully drawn or cocked position shown in FIG. 1. The amount of full draw of the bow may be adjusted by means of the stop collar 18 by positioning it at a desired location along the rear end of the drawback rod 14. The stop collar 18 is secured at the desired loation by set screw 19 (FIG. 3). When in the position illustrated in FIG. 1, the crossbow 10 is in its full drawn position and an arrow 54 may be placed alongside the releasable catch 52 to engage the bowstring 13 in the conventional manner and the crossbow 10 is ready to be fired.

Referring again to FIG. 3, it can be seen that the cocking mechanism 16 comprises a lock lever 60 which has its upper end pivotally secured in a recess 62 in the housing 40 and is biased rearwardly (to the right as viewed in FIG. 3) by the action of a coil spring 64 that is disposed around the drawback rod 14 and bears against a flange 66 that forms the through bore 46. The spring 64 urges the lower end 68 of the lock lever 60 into abutment with the inner surface of the release button 50.

The cavity 51 mounts a coil spring 74 sandwiched between a release plate 70 and a cocking plate 72. The spring 74 urges the cocking plate 72 into abutment with the flange 66 and the release plate 70 into engagement with a shoulder 73 on the releasable catch 52. The release plate 70, the cocking plate 72 and the lock lever 60 are all apertured at their respective midsections and are slidable along the length of the drawback rod 14. The release plate 70 has a lower end that is sandwiched between a trigger 76 and a safety button 78 which, in turn, holds the trigger 76 in a captive position as the trigger's opposite side abuts a stationery trigger stop 79. Compression of the coil spring 74 against the release plate 70 holds the same in place such that the upper end of the release plate 70 engages the shoulder 73 in the catch 52 to maintain the same in the string-engaging position illustrated. It can thus be seen that when the crossbow 10 is in its fully drawn or cocked position, the bowstring 13 will exert a force against the catch 52, tending to rotate the same in a clockwise direction as viewed in FIG. 3, which rotation is resisted by the release plate 70. As will be described hereinafter, movement of the release plate 70 from engagement with shoulder 73 will permit the catch 52 to rotate clockwise and release the bowstring 13.

Still referring to FIG. 3, it can be seen that the cocking handle 42 is pivotally mounted to the cocking mechanism housing 40 by a suitable pin 18 such that when the cocking handle 42 is grasped in a pistol-like fashion and squeezed, the upper end 75 of the cocking handle 42 engages the cocking plate 72 and, under great mechanical leverage advantage, pushes the same toward the forward end of the cocking mechanism 16, tilting the cocking plate 72 slightly and thus locking the apertured surface of the cocking plate 72 to the rod 14. As the cocking handle 42 is rotated through a full stroke, it compresses the coil spring 74 and, since the cocking plate 72 is locked to the rod 14, there is relative movement between the rod 14 and the cocking mechanism 16; that is, the cocking mechanism 16 will move toward the stop collar 18. At the same time the cocking handle 42 is being compressed and there is relative movement between the mechanism 16 and the rod 14, the lock lever 60 will pivot in the housing recess 62, to a position perpendicular to the rod 14 releasing the rod 14 and permitting relative movement between the lock lever 60 and the rod 14. Releasing the cocking handle 42 and allowing the same to return to the initial position under the action of the spring 74 positions the handle 42 for another stroke.

At the same time that the cocking handle 42 is released, spring 64 pivots the lock plate 60 to the position illustrated whereupon its apertured surface lockingly engages the rod 14 and locks the cocking mechanism 16 in position. The sequence is then repeated to move the locking mechanism 16, and thus the bowstring, rearwardly step by step along the length of the rod 14 until the locking mechanism 16 abuts the stop collar 18. When the cocking handle 42 has been manipulated a sufficient number of times to translate the cocking mechanism 16 the full length of the drawback rod 14, a push button 82 may be pushed into place to prevent the accidental disengagement of the lock lever 60 from its locked position. When the user is ready to fire the crossbow 10, a suitable bolt or arrow 54 is positioned on the rod 14 and a safety button 78 is shifted out of position so as to allow pivoting of the release plate 70 when the trigger 76 is actuated in the conventional manner. When trigger 76 is actuated, the upper end thereof will rotate in a counterclockwise direction about support pin 84 to allow the release plate 70 to tilt about pivot point 88 to disengage from the releasable catch 52, allowing the catch 52 to rotate clockwise and thereby release the bowstring, projecting the arrow 54 from the crossbow.

It should be understood by those skilled in the art of crossbows that while Applicant has disclosed one example of the present invention, other forms of the invention may be had, all coming within the spirit of the invention and scope of the appended claims.

What is claimed is as follows:

1. In a bow having a bow prod, and a bow string coupled to the ends of said prod, an elongated rod fixedly mounted at its forward end to the center of said prod and extending rearwardly from said prod, and a cocking mechanism including a housing mounted on said rod for movement longitudinally of said rod, said mechanism including trigger means operable to releasably couple said string to said housing;

the improvement wherein said cocking mechanism further comprises a cocking plate and a lock lever each having a rod-receiving aperture therethrough dimensioned to accommodate longitudinal sliding movement of said rod relative to the plate and lock lever when the plate and lock lever are disposed perpendicular to the longitudinal axis of said rod and to lock said plate and lock lever to said rod to prevent longitudinal sliding movement of said rod relative thereto when tilted relative to the rod axis, first abutment means in said housing establishing a normal rest position of said cocking plate wherein said cocking plate is perpendicular to the axis of said rod, an actuating lever pivotally mounted in said housing for pivotal movement between a normal position and an actuated position, said actuating lever being engaged with the rearward side of said cocking plate and being operable upon movement from said normal position to said actuated position to tilt said cocking plate into locked engagement with said rod and to urge said cocking mechanism through one step of movement rearwardly relative to said rod and away from said bow prod, second abutment means in said housing establishing a normal rest position of said lock lever wherein said lock lever is tilted into locked engagement with said rod to prevent movement of said cocking mechanism relative to said rod, said second abutment means accommodating movement of said lock lever into perpendicular relation with said rod axis upon rearward movement of said cocking mechanism relative to said rod initiated by movement of said actuating lever into its actuated position and return of said locking lever to its normal rest position to prevent forward movement of said cocking mechanism relative to said rod whereby said cocking mechanism may be advanced rearwardly relative to said rod in step by step movement by successive movements of said actuating lever from its normal to its actuated position and further comprising:

lock button means operable to lock said lock lever in its normal rest position.

2. The invention defined in claim 1 further comprising release button means in said housing operable to maintain said lock lever in perpendicular relationship to said rod axis to accommodate free sliding movement of said cocking mechanism relative to said rod to enable the initial coupling of said trigger means to said bow string.

* * * * *